US010344426B2

(12) United States Patent
Jarrard et al.

(10) Patent No.: US 10,344,426 B2
(45) Date of Patent: Jul. 9, 2019

(54) OLEOPHOBIC INSULATING SHIELD AND METHOD OF MAKING

(71) Applicant: LYDALL, INC., Manchester, CT (US)

(72) Inventors: Brian Matthew Jarrard, Thurmond, NC (US); Liam Daniel Green, Greenville, SC (US); Michael Shane Jolly, Winston Salem, NC (US)

(73) Assignee: LYDALL, INC., Manchester, CT (US)

( * ) Notice: Subject to any disclaimer, the term of this patent is extended or adjusted under 35 U.S.C. 154(b) by 589 days.

(21) Appl. No.: 15/072,651

(22) Filed: Mar. 17, 2016

(65) Prior Publication Data

US 2016/0273142 A1 Sep. 22, 2016

Related U.S. Application Data

(60) Provisional application No. 62/136,116, filed on Mar. 20, 2015.

(51) Int. Cl.
*D06M 10/02* (2006.01)
*D06M 10/10* (2006.01)
(Continued)

(52) U.S. Cl.
CPC ..... *D06M 10/02* (2013.01); *D06M 10/10* (2013.01); *D06M 15/256* (2013.01); *D06M 23/16* (2013.01); *F02B 77/11* (2013.01); *F02B 77/13* (2013.01); *D06M 2101/32* (2013.01); *D06M 2200/11* (2013.01); *D06M 2200/30* (2013.01)

(58) Field of Classification Search
CPC .... D06M 10/02; D06M 10/10; D06M 15/256; D06M 23/16; D06M 2101/32; D06M 2200/11; D06M 2200/30; F02B 77/11; F02B 77/13
See application file for complete search history.

(56) References Cited

U.S. PATENT DOCUMENTS 3,202,541 A * 8/1965 Hochberg ..... C08F 291/00 427/389.9
5,482,765 A 1/1996 Bradley et al.
(Continued)

FOREIGN PATENT DOCUMENTS

JP H-01182142 A 7/1989
JP H-05321150 A 12/1993
(Continued)

OTHER PUBLICATIONS

Chemours, Teflon Fluoroplastic Resins-Zonyl (R) PTFE, date unknown. (Year: 0000).*
(Continued)

*Primary Examiner* — Cephia D Toomer
(74) *Attorney, Agent, or Firm* — Moyles IP, LLC

(57) ABSTRACT

According to some embodiments, a material and a method of providing thermal and acoustical insulation with an insulating shield that is moldable and self-supporting insulating shield, is presented. The shield includes a nonwoven material and an oleophobic coating applied to the outer surface of the nonwoven material. The oleophobic coating includes a percent add-on (% AO) of less than approximately 3% AO and a penetration into the surface of the nonwoven material of less than approximately 10%.

15 Claims, 4 Drawing Sheets

(51) Int. Cl.

| | |
|---|---|
| ***D06M 15/256*** | (2006.01) |
| ***D06M 23/16*** | (2006.01) |
| ***F02B 77/11*** | (2006.01) |
| ***F02B 77/13*** | (2006.01) |
| *D06M 101/32* | (2006.01) |

(56) References Cited

U.S. PATENT DOCUMENTS

| | | | |
|---|---|---|---|
| 6,063,474 | A | 5/2000 | Raiford et al. |
| 6,123,172 | A | 9/2000 | Byrd et al. |
| 6,485,785 | B1 | 11/2002 | Mino et al. |
| 6,602,437 | B1 | 8/2003 | Miller et al. |
| 6,673,125 | B2 | 1/2004 | Miller et al. |
| 7,225,487 | B2 | 6/2007 | Small, Jr. et al. |
| 7,402,537 | B1 | 7/2008 | Lenda et al. |
| 7,491,438 | B2 | 2/2009 | Demott et al. |
| 7,500,541 | B2 | 3/2009 | Schmidt et al. |
| 2001/0030023 | A1 | 10/2001 | Tippett |
| 2004/0242109 | A9 | 12/2004 | Tilton et al. |
| 2009/0085378 | A1 | 4/2009 | Borchardt et al. |
| 2010/0108775 | A1 | 5/2010 | Donaty |

FOREIGN PATENT DOCUMENTS

| | | | |
|---|---|---|---|
| JP | 2004293007 | A | 10/2004 |
| WO | WO-02098707 | A1 | 12/2002 |

OTHER PUBLICATIONS

International Search Report and Written Opinion of International Application No. PCT/US2016/022780, dated Jun. 24, 2016.

R.L. Hudson & Company, Tetrafluoroethylene., O-Ring Design & Materials Guide, http://rlhudson.com/O-Ring/selecting-materials18.html, downloaded Mar. 3, 2015.

EP Search Report and Opinion of EP16716963.0, which is in the same family as U.S. Appl. No. 15/072,651, dated Nov. 28, 2018, 5 pages.

* cited by examiner

OLEOPHOBIC INSULATING SHIELD AND METHOD OF MAKING

CROSS-REFERENCE TO RELATED APPLICATIONS

This application claims benefit of U.S. Provisional Application No. 62/136,116 filed Mar. 20, 2015, which is incorporated herein by reference in its entirety.

FIELD

A material and method for an oleophobic insulating shield are generally described.

BACKGROUND

Thermal and acoustical insulating shields, to which the presently described embodiments are an improvement, have long been known in the art. Such shields are used in a wide variety of applications, among which are shielding in space crafts, automobiles, home appliances, electronic components, industrial engines, boiler plants and the like, and are commonly referred to as heat shields, acoustical panels, thermal and acoustical barriers, insulating shield, and the like. As used herein, such terms are considered interchangeable. Some of such shields have proportionally smaller thermal insulating value and proportionally higher acoustical insulating value, and vice versa. There are, of course, shields that lie therebetween. Such shields may be used, for example, between an object to be protected, i.e. shielded, for example, the floor pan of an automobile, and a heat source, for example, a portion of the exhaust system of the automobile. Additionally, such shields may be designed to provide acoustical shielding.

As these shields are designed to be used in automobiles in high temperature environments, the shields may be required to meet certain standards set by the automotive industry for flame resistance. Additionally, the shield may come into contact with other materials in the automobile, such as engine oil, which may affect the flammability, and also the effectiveness, of the shield. Past methods for providing acoustic and thermal shielding have failed to meet new flammability requirements without sacrificing the acoustic shielding properties, the thermal shielding properties, and/or increasing the cost of manufacture.

In view of the disadvantages associated with currently available methods and devices for providing thermal and acoustical shielding, there is a need for a device and method that maintains thermal and acoustical performance, while also meeting flammability requirements (or standards) and cost expectations.

BRIEF DESCRIPTION

According to an aspect, the present embodiments may be associated with moldable, self-supporting insulating shields providing thermal and acoustical shielding (or insulation) including a nonwoven material with an oleophobic coating applied thereon.

More specifically, the present embodiments relate to a method for forming a moldable self-support insulation shield.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of scope, exemplary embodiments will be described and explained with additional specificity and detail through the use of the accompanying drawings in which.

Figure 1A:
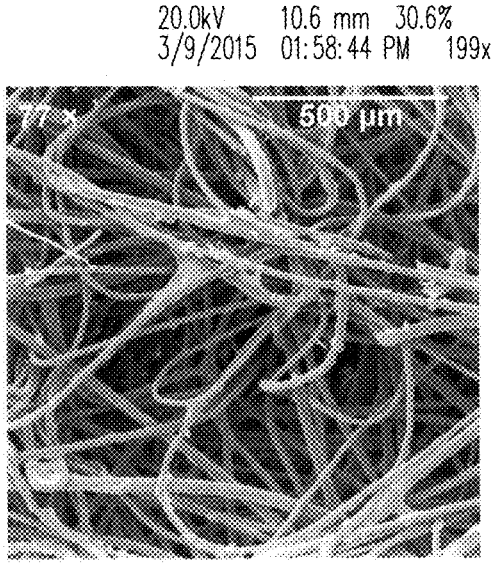
FIG. 1A (PRIOR ART)
FIGS. 1A-1C illustrate magnified scanning electron microscopic (SEM) views of the material of a prior art shield.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

As used herein the term "nonwoven material or fabric or web" means a web having a structure of individual fibers or threads which are interlaid, but not in an identifiable manner as in a knitted fabric. Nonwoven fabrics or webs have been formed from many processes such as for example, melt-blowing processes, spunbonding processes, bonded carded web processes, and needle punch (NP) felt processes.

For purposes of illustrating features of the embodiments, a simple example will now be introduced and referenced throughout the disclosure. Those skilled in the art will recognize that this example is illustrative and not limiting and is provided purely for explanatory purposes.

Embodiments of the disclosure relate generally to methods and materials for providing insulative properties, specifically thermal and acoustical shielding, as well as insulating materials having increased non-flammability features. Such materials find particular utility in vehicle and appliance compartments. For example, the materials described herein may include a moldable, self-supporting insulating shield, such as a nonwoven material, wherein the nonwoven material may provide thermal and acoustical insulation. In some embodiments, the nonwoven material may include a single layer. In some embodiments, the insulating shield may include a coating applied to the surface(s) of the nonwoven material, wherein the coating may include an oleophobic (oil repelling) material. The oleophobic coating may be applied to at least one surface of the nonwoven material. The oleophobic coating may be operable to prevent oil from absorbing into the nonwoven material. Additionally, the oleophobic coating may include a non-flammable material. In some embodiments, the oleophobic coating may include polyethylene terephthalate (PET). In some embodiments, the oleophobic coating and/or the nonwoven material may not include a flame retardant material, wherein the necessary flame retardant properties may be provided by the oleophobic coating. In alternative embodiments, a flame retardant material may be included in the oleophobic coating and/or the nonwoven material. In some embodiments, the oleophobic coating may include a water repellant material.

As described herein, the insulating shield typically includes at least one layer of the nonwoven material, the nonwoven material being operable to provide thermal and acoustical insulation in use. In an embodiment, the nonwoven material is a fibrous insulation batt. In yet a further embodiment, the nonwoven material is a needled, flexible, fibrous batt. In some embodiments, the nonwoven material is a needle punch felted material.

The insulating shield further includes the oleophobic coating applied to at least one outer surface of the nonwoven material, that is to a surface(s) of the shield abutting and/or affixed to the vehicle or appliance compartment, (e.g., the treated side is facing the source of the oil, which would be the engine compartment), opposite a surface of the shield exposed to the air, while in an embodiment, the oleophobic coating is applied to all of the outer surfaces of the nonwoven material.

Additionally, the oleophobic coating may prevent oil from absorbing into the nonwoven material while also maintaining the acoustical insulating properties of the shield. In alternative embodiments, layers of material may be attached to (or laminated to) the nonwoven material, depending on the application of the shield. For example, a layer of aluminum, a barrier film, or any other required material may be attached to the nonwoven material.

Prior art shields typically included a scrim to be laminated to the nonwoven material, wherein the scrim may contain oleophobic chemistry. Prior art shields may also include a solid film attached to at least one surface of the nonwoven material, operable to prevent oil from absorbing into the nonwoven material. In some embodiments of the disclosure, the shield may be self-supporting, and may not require any support elements, such as a scrim, to be attached to the nonwoven material. This may provide improved air flow characteristics for the shield, thereby maintaining acoustical insulating properties of the shield.

In some embodiments, the shield may be tested to meet self-extinguishing standards when tested in a horizontal burn cabinet. In some embodiments, the testing includes exposing a shield to approximately 200 mL of engine oil (5W-20 for example) and then testing the shield in a horizontal burn cabinet. It is desirable that all samples of the shield self-extinguish to pass the testing. In some embodiments, the nonwoven material may shrink away from the flame. In some embodiments, the weight gain of the nonwoven material when exposed to the engine oil may be less than approximately 50%. In some embodiments, the weight gain of the nonwoven material when exposed to the engine oil may be less than approximately 22%.

In some embodiments, the oleophobic coating may be applied only on the surface of the nonwoven material, such that it does not penetrate into more than about 10% of the nonwoven material. Thus, in some embodiments, the coating penetration into the nonwoven material is less than approximately 10% of the total thickness of the nonwoven material. In yet further embodiments, the coating penetration into the nonwoven material is less than approximately 5% of the total thickness of the nonwoven material. In some embodiments, the coating penetration into the nonwoven material is less than approximately 500 microns (or 0.5 mm). In some embodiments, the coating penetration into the nonwoven material is less than approximately 210 microns (or 0.21 mm).

Applying the coating to the surface of the nonwoven material or fibrous batt may reduce the cost of applying coating, reduce the weight of the combined material, and reduce the effect of the coating on the air flow characteristics of nonwoven material. In some embodiments, the coating may be applied to the nonwoven material using ultrasonic spraying. In other embodiments, other spraying methods may be used to apply the coating to the nonwoven material. In other embodiments, the coating may be applied using gravure rolling, kiss coating, knife over edge, Mayer rod, among other similar coating techniques, as known by those skilled in the art.

Another measurement of the coating that may be used is a percent add-on (% AO) wherein the percent add-on measures the weight of the coating and the nonwoven material as a ratio to the weight of the nonwoven material without the coating applied. In some embodiments, the coating material includes a percent add-on of less than approximately 3% AO. In some embodiments, the coating material includes the percent add-on of less than approximately 1% AO. In some embodiments, the coating includes the percent add-on of between about 0.05% AO and about 1% AO. In some embodiments, the coating includes the percent add-on of between about 0.05% AO and about 0.3% AO.

Figure 1B:
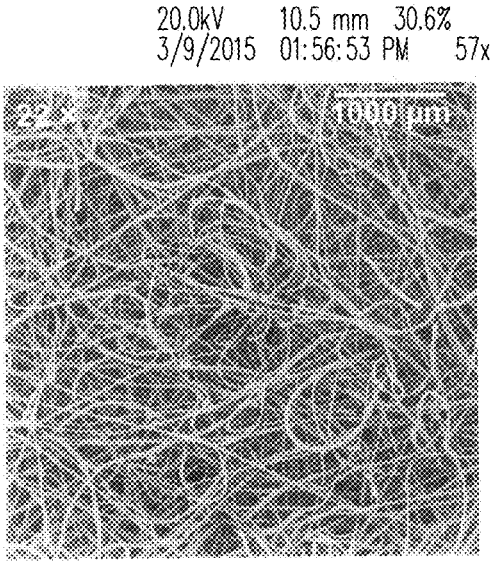
FIG. 1B (PRIOR ART)
Figure 1C:
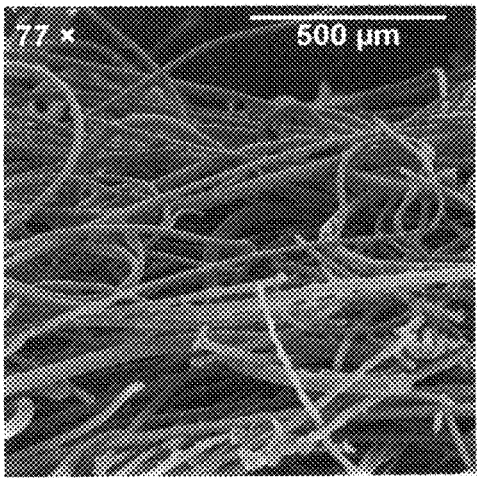
FIG. 1C (PRIOR ART)

Some prior art shields include a coating that is applied to the nonwoven material of the shield using a "lick coating" or roll coating method. FIGS. 1A-1C display various SEM views (at varying magnification levels as indicated in the figures) of an example of such prior art, wherein the coating that is applied in a traditional manner penetrates the nonwoven material through more than 50% of the thickness of the nonwoven material. As can be seen in FIGS. 1A-1C, there exists a large concentration of the coating material on the fibers of the nonwoven material. However, in this specific embodiment, the nonwoven material is approximately 6 millimeters (mm) thick, and the coating is visible penetrating the nonwoven material up to approximately 4 mm. In this example of a prior art material, the coating has been applied at 5% AO.

Figure 2A:
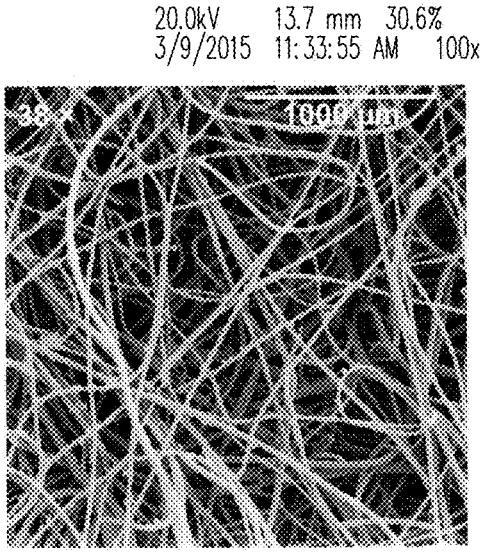
FIGS. 2A-2C illustrate magnified SEM views of the material of a insulating shield, according to an embodiment of the disclosure.
Figure 2B:
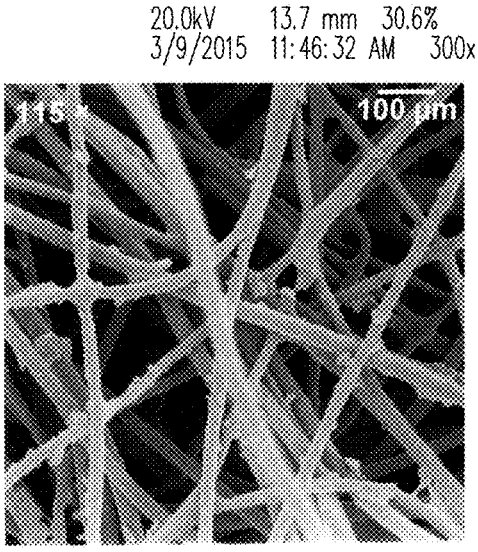
Figure 2C:
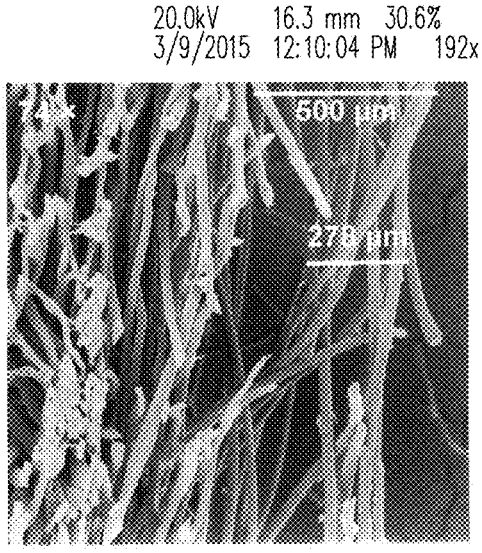

FIGS. 2A-2C display SEM views (at varying magnification levels as indicated in the figures) of the insulating shield according to the present disclosure. In FIGS. 2A-2C, the coating material has been applied to the nonwoven material using an ultrasonic spraying method. In this embodiment, there is a high concentration of coating located only on the surface fibers of the nonwoven material, and the penetration of the coating material is only approximately 4 to 6 fibers deep. The percent add-on was determined to be 0.16% AO, and the penetration was less than 4.2%.

Figure 3:
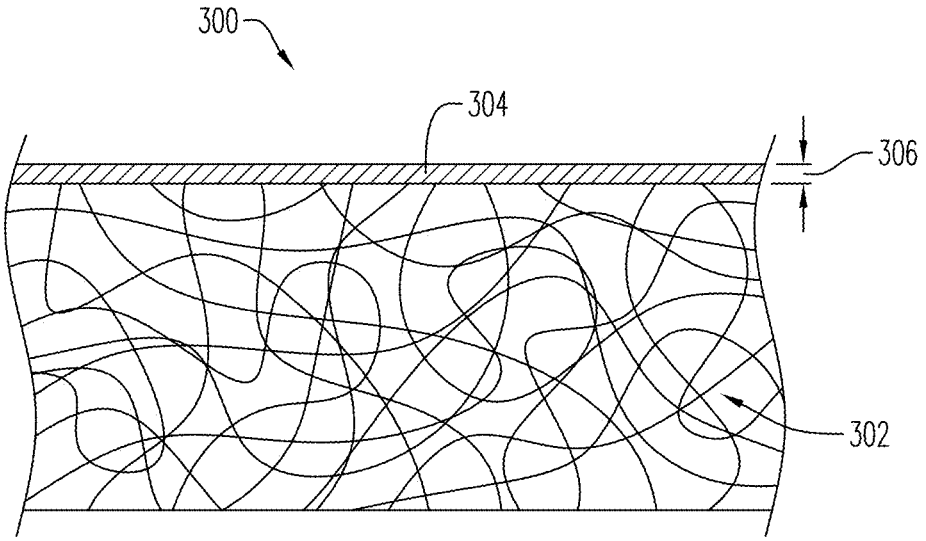
FIG. 3 illustrates a side-view of a shield, according to an embodiment of the disclosure.

FIG. 3 illustrates a highly stylized diagram of an exemplary shield 300 according to an embodiment of the disclosure. In some embodiments, the shield 300 includes the moldable, self-supporting insulating shield. In some embodiments, the shield 300 includes the nonwoven material 302 operable to provide thermal and acoustical insulation. In some embodiments, the shield 300 includes an oleophobic coating 304 applied to at least one of the outer surfaces of the nonwoven material 302. Although it may appear as though the coating 304 is a separate layer, the coating 304 is actually applied to the nonwoven material 302 in such a way that the oleophobic coating 304 penetrates (depicted as a penetration level or thickness 306) into the surface of the nonwoven material 302 by less than approximately 10%. In some embodiments, the oleophobic coating 304 includes a penetration 306 into the surface of the nonwoven material of less than approximately 0.5 millimeters.

In some embodiments, the oleophobic coating 304 may provide improved flame resistant qualities to the shield 300, particularly when the shield has come in contact with (and possibly absorbed) an oil material, such as engine oil. In some embodiments, the shield 300 may meet self-extinguish flammability standards when exposed to approximately 200 milliliters of engine oil, per test sample, and tested in a horizontal burn cabinet.

In some embodiments, the oleophobic coating 304 may allow for air flow through the nonwoven material 302, such that the nonwoven material 302 maintains acoustical insulation properties. The acoustical insulation may be defined by the air flow properties of the nonwoven material 302 and/or the coating 304. For example, the shield 300 may include air flow characteristics providing acoustical insulation, wherein the shield 300 includes less than approximately 5000 MKS Rayls. In some embodiments, the shield 300 includes between approximately 500 and 2000 MKS Rayls.

In some embodiments, the nonwoven material 302 includes a needle punch felted polyethylene terephthalate (PET) material operable to provide thermal and acoustical insulation, and an oleophobic polytetrafluoroethylene (PTFE) coating ultrasonically sprayed onto the outer surface of the PET material. In alternative embodiments, the nonwoven material 302 includes one or more additional layers including but not limited to melamine foam, resonated fiberglass batting, other batting materials, and the like. In some embodiments, the nonwoven material 302 includes approximately 50% to approximately 100% PET. In some embodiments, the nonwoven material 302 includes approximately 100% PET. In some embodiments, the oleophobic coating 304 includes a water repellant. In some embodiments, the oleophobic coating 304 includes polytetrafluoroethylene (PTFE). In some embodiments, the nonwoven material 302 includes a density of approximately 240 kilogram (kg) per cubic meter to approximately 667 kg per cubic meter.

Figure 4:
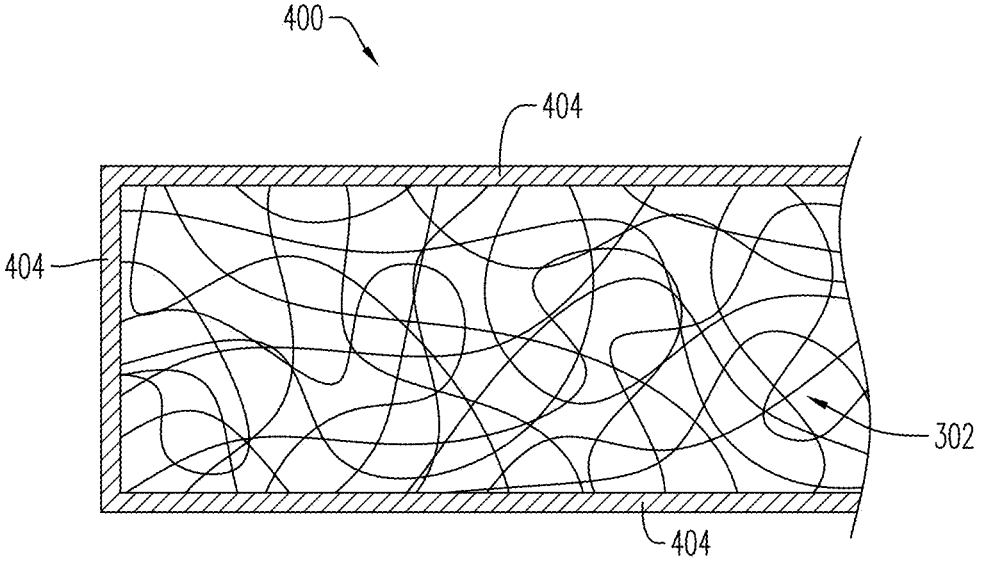
FIG. 4 illustrates a side-view of another shield, according to an embodiment of the disclosure.

FIG. 4 illustrates another highly stylized exemplary embodiment of a shield 400. The shield 400 may be similar to the shield 300 described in FIG. 3. The shield 400 includes a nonwoven material 402 and a coating 404. In the embodiment of FIG. 4, the coating 404 may be located on a plurality of the outer surfaces of the nonwoven material 402.

Figure 5:
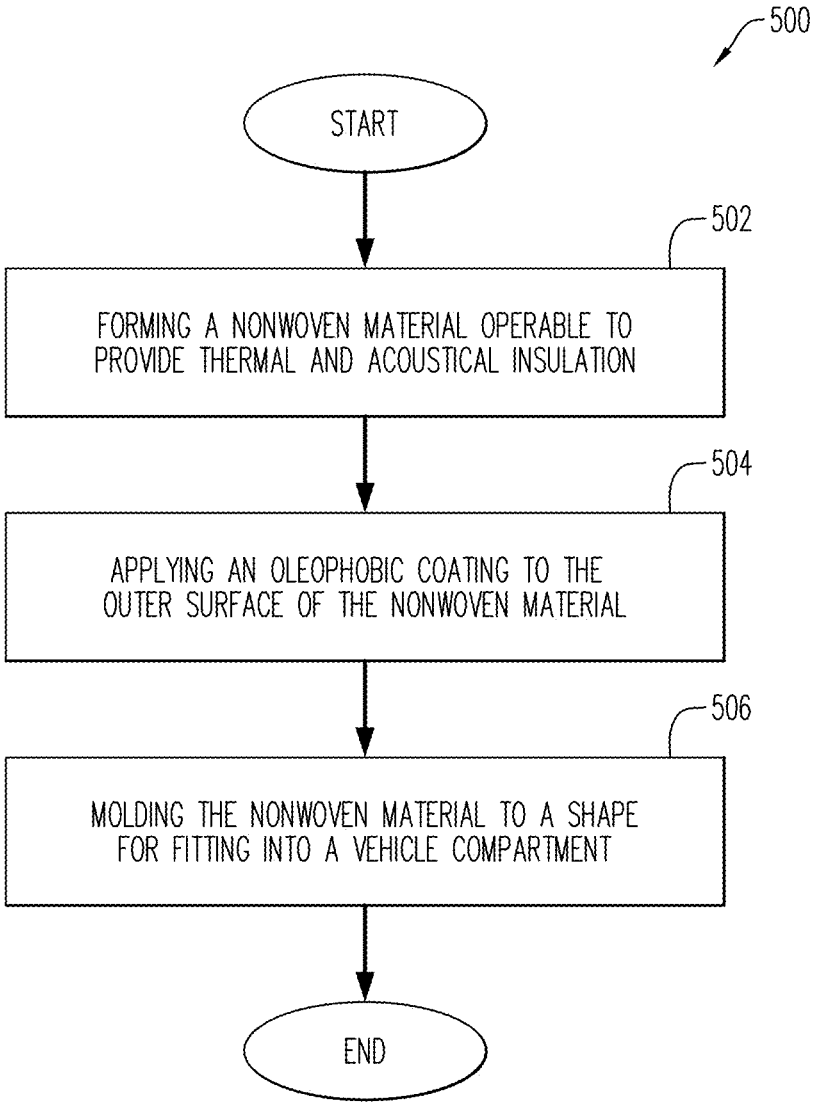
FIG. 5 illustrates a method for forming a moldable, self-supporting insulating shield according to an embodiment of the disclosure.

FIG. 5 illustrates a method 500 for forming a moldable, self-supporting insulating shield. At step 502, a nonwoven material may be formed, wherein the nonwoven material may be operable to provide thermal and acoustical insulation. At step 504, an oleophobic coating may be applied to the outer surface of the nonwoven material. In some embodiments, the oleophobic coating includes PTFE. In some embodiments, at step 506, the nonwoven material may be molded into a shape for fitting into a vehicle or appliance compartment. In some embodiments, step 506 may occur before step 504, wherein the nonwoven material may be molded into a shape before the oleophobic coating is applied to the surface of the nonwoven material.

In some embodiments, the PTFE coating includes a percent add-on (% AO) of less than approximately 3% AO. In some embodiments, the PTFE coating includes a penetration into the surface of the nonwoven material of less than approximately 10%. In some embodiments, applying the PTFE coating to the outer surface of the nonwoven material (step 504) includes ultrasonically spraying the PTFE coating onto the outer surface of the nonwoven material. In some embodiments, the nonwoven material includes needle punch felted PET. In some embodiments, the nonwoven material and the oleophobic PTFE coating includes air flow characteristics providing acoustical insulation. In some embodiments, the nonwoven material may be pretreated with the oleophobic coating before being needle punch felted.

COMPARATIVE EXAMPLES

Heat shields according to the prior art were prepared in which a nonwoven material (the same material as described below with respect to the example according to an embodiment) was treated with a PTFE finish. This PTFE finish was applied to a coverstock, (a light weight felt), in a saturation process so that 100% of the fibers are treated, as would be understood by those of ordinary skill in the art. The coverstock is primarily made of polyester fibers, and is coated in a padding process. The coverstock is later laminated to the needle punch polyester felt using an adhesive. The lamination process occurs before molding. The comparative samples were molded into 1500 grams per square meter (gsm) belly pans.

The comparative samples were tested according to WSS-M99P32-D4, Section 3.4.11.3/SAE J369, (Ford Motor Company's test method), in which the specimens were suspended over a pan to catch flow through oil. Engine oil (SAE 5W-20) was poured at room temperature over the top surface, (e.g., the black side of the sample (or a first side)). After 10 minutes the specimens were placed in a vertical position and the oil was drained off for 20 minutes. The flammability test was started immediately following the 20 minute drain. Two of the comparative samples were soaked for 10 minutes with 10 ml of engine oil (5W-20) and then drained for 20 minutes. Two of the comparative samples were soaked for 10 minutes with 100 ml of engine oil (5W-20) and then drained for 20 minutes. The comparative samples were then tested in a horizontal flame cabinet, where the flame was placed on the grey side of the sample (or a second side). To meet Self-Extinguish (SE) and/or No Burn Rate (NBR) standards, the sample should not glow or smolder after the flame has been extinguished. All of the comparative samples passed the SE test.

EXAMPLES

In an example and as depicted in FIGS. 2A-2C and discussed above, samples of a shield according to an embodiment were prepared. In the samples, the nonwoven material, labeled CB62560, was a needle punch felt, weighing approximately 6.25 ounces per square foot (osf), prior to treatment, and composed of both staple polyester fibers and low melt binder polyester fibers. In this example, the percentage of low melt polyester fibers is ~40 wt. %, and the staple polyester fibers are ~60 wt. %. The nonwoven material was treated (hand-sprayed) with C6 PTFE chemistry, including 19% solids, in a 5% solution and 15% Wet Pick Up, (WPU, which is a percentage of weight gain after adding the wet chemistry, relative to the initial weight of the sample, when dry). For example, in this sample, the material weighed 6.25 ounces per square foot (osf) prior to treatment, and then the sample had 15% WPU, then the wet chemistry was 0.15×6.25=0.9375osf. This is the added weight before drying and removing the water. The percent add-on was determined to be 0.16% AO, the penetration was less than 4.2%, and air flow resistance was ~1600 mks Rayls. The samples were molded in a chilled compression mold tool. The samples were suspended over a pan to catch flow through oil, and 200 milliliters (ml) of engine oil (SEA 5W-20) at room temperature were poured over the top surface of each test sample, as described in detail above, with the exception that the samples were subjected to 200 ml of oil, rather than 100 ml. After 10 minutes, the samples were place in a vertical position and drained of the oil for 20 minutes. The samples were then immediately tested in a horizontal burn cabinet, wherein the flame was applied to the engine side of the component, that is, the side of the component that would be subjected to the environmental conditions found in the vehicle compartment. To meet Self-Extinguish (SE) and/or No Burn Rate (NBR) standards, the sample should not glow or smolder after the burner flame has been extinguished. As shown in Table 1, ten of the samples passed the SE test.

TABLE 1

| No. | Test Name | Test Procedure | Test Requirements | Test # | Descriptive Results Sample | Result | Pass/Fail |
|---|---|---|---|---|---|---|---|
| 1 | Flammability | WSS-M99P32-D, Section 3.4.11.3/SAE J369 - Suspend specimens over a pan to catch flow through oil. Pour 100 ml of engine oil (SAE 5W-20) at room temperature over the top surface. After 10 minutes place specimen in a vertical position and drain oil off for 20 minutes. Test immediately following the 20 minute drain. Flame should be applied to the road side of the component. | SE/NBR, max The material shall not glow or smolder after the flame extinguishes. | 31840 | 1 | SE/0 | Pass |
| | | | | | 2 | SE/0 | |
| | | | | | 3 | SE/0 | |
| | | | | | 4 | SE/0 | |
| | | | | | 5 | SE/0 | |
| | | | | | 6 | SE/0 | |
| | | | | | 7 | SE/0 | |
| | | | | | 8 | SE/0 | |
| | | | | | 9 | SE/0 | |
| | | | | | 10 | SE/0 | |
| | | | | | Thickness | 3.2 mm | |
| | | | | | Flame to grey side | | |

The weights of five of the samples are shown below in Table 2.

TABLE 2

Weight data of 5 samples before and after oil application and after draining (Samples 4" × 14")

| Sample | Sample weight before oil application (ounces) | Sample weight after oil application (ounces) | Sample weight after 20 minute drainage (ounces) | Absorption after Draining (% Weight Gain) |
|---|---|---|---|---|
| 1 | 2.5 | 3.15 | 2.80 | 12.0% |
| 2 | 2.3 | 3.80 | 2.75 | 19.6% |
| 3 | 2.5 | 3.70 | 2.80 | 12.0% |
| 4 | 2.6 | 3.75 | 2.90 | 11.5% |
| 5 | 2.5 | 3.55 | 2.75 | 10.0% |
| AVG | 2.48 | 3.59 | 2.80 | 12.9% |

The materials and methods illustrated are not limited to the specific embodiments described herein, but rather, features illustrated or described as part of one embodiment can be used on or in conjunction with other embodiments to yield yet a further embodiment. It is intended that the materials and methods include such modifications and variations. Further, steps described in the method may be utilized independently and separately from other steps described herein.

While the materials and methods have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" or "approximate" is not to be limited to the precise value specified. In some instances, the approximating language may correspond to the precision of an instrument for measuring the value. Terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the materials and methods, including the best mode, and also to enable any person of ordinary skill in the art to practice these, including making and using any devices or systems or materials and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A moldable, self-supporting insulating shield comprising:

a needle punch felted polyethylene terephthalate (PET) material operable to provide thermal and acoustical insulation; and an oleophobic polytetrafluoroethylene (PTFE) coating ultrasonically sprayed onto a plurality of outer surfaces of the PET material, wherein:

the PTFE coating comprises a percent add-on (% AO) of less than approximately 1% AO; and the PTFE coating comprises a penetration into the outer surfaces of the needle punch felted PET material of less than approximately 0.5 millimeters.

2. The shield of claim 1, wherein the oleophobic material comprises a penetration into the outer surfaces of the needle punch felted PET material of less than approximately 10%.

3. The shield of claim 1, wherein the oleophobic material comprises a penetration into the outer surfaces of the needle punch felted nonwoven material of less than approximately 5%.

4. The shield of claim 1, wherein the needle punch felted nonwoven material comprises a density of approximately 240 kilogram (kg) per cubic meter to approximately 667 kg per cubic meter.

5. The shield of claim 1, wherein the needle punch felted nonwoven material comprises approximately 100% PET material.

6. The shield of claim 1, wherein the shield meets flammability standards when exposed to approximately 200 milliliters of engine oil and tested in a horizontal cabinet.

7. The shield of claim 1, wherein the PTFE coating comprises a solids content of up to approximately 19%.

8. The shield of claim 1, wherein the needle punch felted PET material comprises up to 40% of low melt fibers and up to 60% of staple fibers.

9. The shield of claim 1, wherein the oleophobic coating comprises a water repellant.

10. The shield of claim 1, wherein the oleophobic coating comprises a percent add-on of approximately 0.05% AO.

11. The shield of claim 1, wherein the shield comprises an air flow resistance of less than approximately 5000 MKS Rayls.

12. The shield of claim 1, wherein the shield comprises an air flow resistance of less than approximately 1600 MKS Rayls.

13. The shield of claim 1, wherein the penetration of the PTFE coating into the outer surfaces is about 4 fibers to about 6 fibers deep.

14. The shield of claim 1, further comprising a layer attached to at least one of the outer surfaces of the needle punch felted PET material.

15. The shield of claim 14, wherein the layer is one or more of melamine foam, resonated fiberglass batting and aluminum.

* * * * *